US005882603A

United States Patent [19]

Taggart

[11] Patent Number: 5,882,603

[45] Date of Patent: Mar. 16, 1999

[54] SUPPORT RACK FOR PIPETTE TIPS

[75] Inventor: Thomas Taggart, Santa Rosa, Calif.

[73] Assignee: Point Plastics Incorporated, Petaluma, Calif.

[21] Appl. No.: 950,551

[22] Filed: Oct. 15, 1997

[51] Int. Cl.[6] ..... B01L 3/02; B65D 85/00

[52] U.S. Cl. ..... 422/104; 422/100; 422/102; 206/443; 211/194

[58] Field of Search ..... 422/99, 100, 102, 422/103, 104; 436/809; 206/443; 211/72, 74, 76, 188, 194

[56] References Cited

U.S. PATENT DOCUMENTS

| | | | |
|---|---|---|---|
| 3,375,934 | 4/1968 | Bates | 211/72 |
| 3,494,201 | 2/1970 | Roach | 73/864.14 |
| 3,643,812 | 2/1972 | Mander et al. | 211/74 |

(List continued on next page.)

FOREIGN PATENT DOCUMENTS

| | | |
|---|---|---|
| 0174706 | 3/1985 | European Pat. Off. . |
| 3924103 | 1/1991 | Germany . |
| 93/08913 | 5/1993 | WIPO . |

OTHER PUBLICATIONS

"Biotec Times Special Edition," A USA/Scientific Plastics, Inc. Publication, vol. 3, No. 1, 2 pages (date unknown, but before Apr. 1997).

"QLS® Quality Loading System," product literature from Quality Scientific Plastics, 2 pages (date unknown, but after Jan. 1996).

"Saving the Enviroment . . . ," a Earth Day Spring Special advertisement mailing from Continental Laboratory Products, 4 pages (date unknown, but before May 1993).

"Saving the Environment is at the Tip of Your Fingers . . . ," advertisement from Continental Laboratory Products, 1 oversize page (date unknown).

"Saving the Environment is at the Tip of Your Fingers . . . ," advertisement from Continental Laboratory Products, 2 pages (date unknown).

"Saving the Environment . . . is at the Tip of Your Fingers," advertisement from Continental Laboratory Products, 2 pages (date unknown).

"Green–Pak™ environmentally–friendly pipette tip–rack refill system," product literature from Rainin Instrument Co., Inc., 3 pages (Oct. 1993).

"Green–Pak SpaceSaver™ the most environmentally–friendly refill system for pipette tip racks," product literature from Rainin Instrument Co., Inc., 4 pages (date unknown).

"Green–Pak SpaceSaver™ The environmentally–friendly refill system for pipette tip racks," product literature for Rainin Instrument Co., Inc., 1 page (1995).

"Green–Pak™ Refills for 10$\mu$ Tip Racks," product literature from Rainin Instrument Co., Inc. 2 pages (Feb. 1995).

General advertisement with attached dealer bulletin from Brinkmann Instrument Co., Inc., 2 pages (Mar. 1993).

(List continued on next page.)

*Primary Examiner*—Harold Y. Pyon

*Attorney, Agent, or Firm*—Majestic, Parsons, Siebert & Hsue

[57] ABSTRACT

A support is provided that is useful with a pipette tip holder for pipette tips. The support has a bottom member and a pair of opposed side walls that extend from the bottom member at least a distance (d). The bottom member and side walls form a cavity. Each side wall defines a slot. The slots are in a facing relationship and extend along a support plane that is parallel to and spaced from the bottom member the distance (d). The slot ends are open on one side so as to receive the pipette tip holder when slidingly inserted into the slots. The side walls preferably include an aligning member adjacent to the open slot end so that the pipette tip holder is aligned in the slots when slid in. Thus, the support supports the pipette tips and pipette tip holder during the pipette tip removal process and resists inadvertent dislodging and lifting of the tips and holder as the tips are removed.

14 Claims, 6 Drawing Sheets

U.S. PATENT DOCUMENTS

| | | | |
|---|---|---|---|
| 3,940,249 | 2/1976 | McClurg | 436/174 |
| 4,124,122 | 11/1978 | Emmitt | 211/74 |
| 4,130,978 | 12/1978 | Cohen | 53/444 |
| 4,286,637 | 9/1981 | Wilson | 141/374 |
| 4,349,109 | 9/1982 | Scordato et al. | 206/562 |
| 4,495,150 | 1/1985 | Cock et al. | 422/990 |
| 4,510,119 | 4/1985 | Hevey | 422/71 |
| 4,517,851 | 5/1985 | Tice | 73/864.91 |
| 4,565,100 | 1/1986 | Malinoff | 73/863.32 |
| 4,577,760 | 3/1986 | Rainin et al. | 206/508 |
| 4,757,898 | 7/1988 | Klein | 206/459 |
| 4,861,554 | 8/1989 | Sakuma | 422/65 |
| 4,895,650 | 1/1990 | Wang | 210/222 |
| 4,936,152 | 6/1990 | Aldred | 73/863.32 |
| 5,036,989 | 8/1991 | Carilli | 211/74 |
| 5,057,282 | 10/1991 | Linder | 422/104 |
| 5,080,232 | 1/1992 | Leoncavallo et al. | 206/446 |
| 5,128,105 | 7/1992 | Berthold et al. | 422/104 |
| 5,133,939 | 7/1992 | Mahe | 422/104 |
| 5,217,694 | 6/1993 | Gibler et al. | 422/104 |
| 5,232,669 | 8/1993 | Pardinas | 422/100 |
| 5,266,272 | 11/1993 | Griner et al. | 422/104 |
| 5,324,482 | 6/1994 | Scaramella et al. | 422/100 |
| 5,378,433 | 1/1995 | Duckett et al. | 422/100 |
| 5,392,914 | 2/1995 | Lemieux et al. | 206/499 |
| 5,456,360 | 10/1995 | Griffin | 206/443 |
| 5,470,538 | 11/1995 | Lind | 422/104 |
| 5,487,997 | 1/1996 | Stolp | 436/54 |
| 5,514,343 | 5/1996 | Verwohlt et al. | 422/104 |
| 5,540,891 | 7/1996 | Portmann et al. | 422/102 |
| 5,592,289 | 1/1997 | Norris | 356/244 |
| 5,622,676 | 4/1997 | Lind | 422/104 |
| 5,630,988 | 5/1997 | Stolp | 422/100 |
| 5,642,816 | 7/1997 | Kelly et al. | 211/60.1 |

OTHER PUBLICATIONS

"Elkay® Elite 54™ Pack Environmental Lite Packaging," product literature form Elkay Labsystems, 2 pages (date unknown).

Advertisement by Scientific Specialites Incorporated, 1 page, undated.

Product Literature from VWR Scientific Products, 3 pages (date unknown).

"Tip Loading System: Compact, Convenient, Economical and Fast," product literature from Corning Costar, 3 pages (date unknown).

"EasyLoad®," advertisement from Greiner Labortechnik, 1 page (date unknown).

SUPPORT RACK FOR PIPETTE TIPS

FIELD OF THE INVENTION

The present invention relates to a support structure adapted to support and hold a pipette tip holder in a position appropriate for removal of pipette tips. The pipette tips and pipette tip holder can be of different types and sizes known in the art.

BACKGROUND OF THE INVENTION

The use of an assembly of disposable pipette tips, a tip holder and a support structure is well known. Typically, a tip holder takes the form of a tray with individual holes for carrying a number of pipette tips, usually ninety-six. The tip holders often come prepackaged with the tips already inserted, but there are also commercially available means of loading loose tips into tip holders. Alternatively, the tips can be manually placed into the holes of a tip holder. Once the tips are loaded into a tip holder, the tip holder is placed over a support structure and the tips, variably with or without the tip holder, are released into the support structure.

The function of the support structure is to provide support during the tip removal process. Typically, the tips are removed when an instrument, either manually or machine operated, is inserted into the larger open top of the tip, and downward pressure is exerted, thus wedging the tip onto the instrument. The tip is then removed from the support structure, used and subsequently discarded.

The support structure acts to provide physical underlying support for this process, such that when downward pressure is exerted, the tip does not move downward or become misaligned with the instrument. If the tip holder has remained on top of the support structure, it also assists by keeping the tips aligned in their respective holes. The tip holder alone does not provide sufficient support, however, because the tip holder is often a fairly thin and flexible tray that is not a free standing independent support mechanism. A support structure for commercially available tip holders is thus required.

In many settings in which pipette tips are used, it is desirable to minimize the user's handling of the tips. However, most prior art tip mounting systems are not fully satisfactory in this regard primarily because the tips are susceptible to becoming displaced from the tip holder and to requiring manual repositioning in the tip holder or support structure. The tips become inadvertently displaced both when they are initially positioned in the support structure and when they are lifted out of the structure for use.

Most prior art tip mounting systems consist of unwieldy tip releasing or tip loading devices. The tip support structures often have 96 individual holes to which the 96 individual pipette tips have to be aligned. Such precise alignment is extremely difficult to achieve with most existing systems. It is therefore desirable to provide a tip support structure that is easy to use and that minimizes the chance of dislodging the tips and tip holder when placing them in the support structure.

Prior to the present invention, it has been observed that when a user is removing a tip from a tip holder, the tip holder may be inadvertently lifted relative to the support structure so that it requires repositioning before use is resumed. Such inadvertent lifting may occur, for example, when a tip or a row of tips is being removed at an angle other than perpendicular to the tip support. When the tip holder is so lifted, typically the user must handle the system to reposition the tip holder and any displaced tips. It is therefore desirable to provide a pipette tip support structure in which the tip holder resists lifting and dislodging of the tips as the tips are removed.

SUMMARY OF THE INVENTION

It is an object of the present invention to provide a support for a pipette tip holder, said support supporting the tips and tip holder during the tip removal process so as to provide for easy alignment of the tips and holder with the support and to resist inadvertent dislodging and lifting of the tips and holder.

In one aspect of the present invention, a support useful with pipette tip holder and pipette tips therein comprises a bottom member and a pair of opposed side walls that are attached to the bottom member and extend at least a distance (d) so as to form a cavity. Each side wall defines a slot with the slots in a facing relationship and extending along a support plane that is parallel to and spaced from the bottom member the distance (d). The slot ends are open on one side so as to receive a pipette tip holder when slidingly inserted into the slots while the other slot ends are closed to stop further sliding of the pipette tip holder therein. The side walls preferably include an aligning member adjacent to the open slot ends. In order to load a pipette tip holder and pipette tips into a support embodiment of the invention, the tips are placed in the pipette tip holder such that a lower portion of the tips extend beyond the holder and the pipette tip holder and tips maintained therein are positioned so as to be aligned with the slots in the support and the pipette tip holder and its tips is then slid into the support from the first slot end.

DETAILED DESCRIPTION OF THE INVENTION

As is known, a typical tip holder of a type known in the art takes the form of a tray with an array (usually ninety-six holes) to receive pipette tips. The tip holder 10 is not free standing and requires support from a tip support in order to be used. The holder often comes packaged with the tips. The pipette tips can be of a variety of sizes and types commercially available and known to those skilled in the art. The particular size and shape of the tips and tip holder are not important for the present invention, which can be adapted to different sizes and types.

The tip fits into and rests on the associated tip holder. As an example, a standard tip has an exterior surface which defines a tapered portion which, when the tip is vertically oriented, is inwardly tapered from an upper portion to a lower portion of the tip. Positioned adjacent the upper portion of the tip, but above a lower end of the tip, is an abutment member. The abutment member rests on the tip holder.

Figure 1:
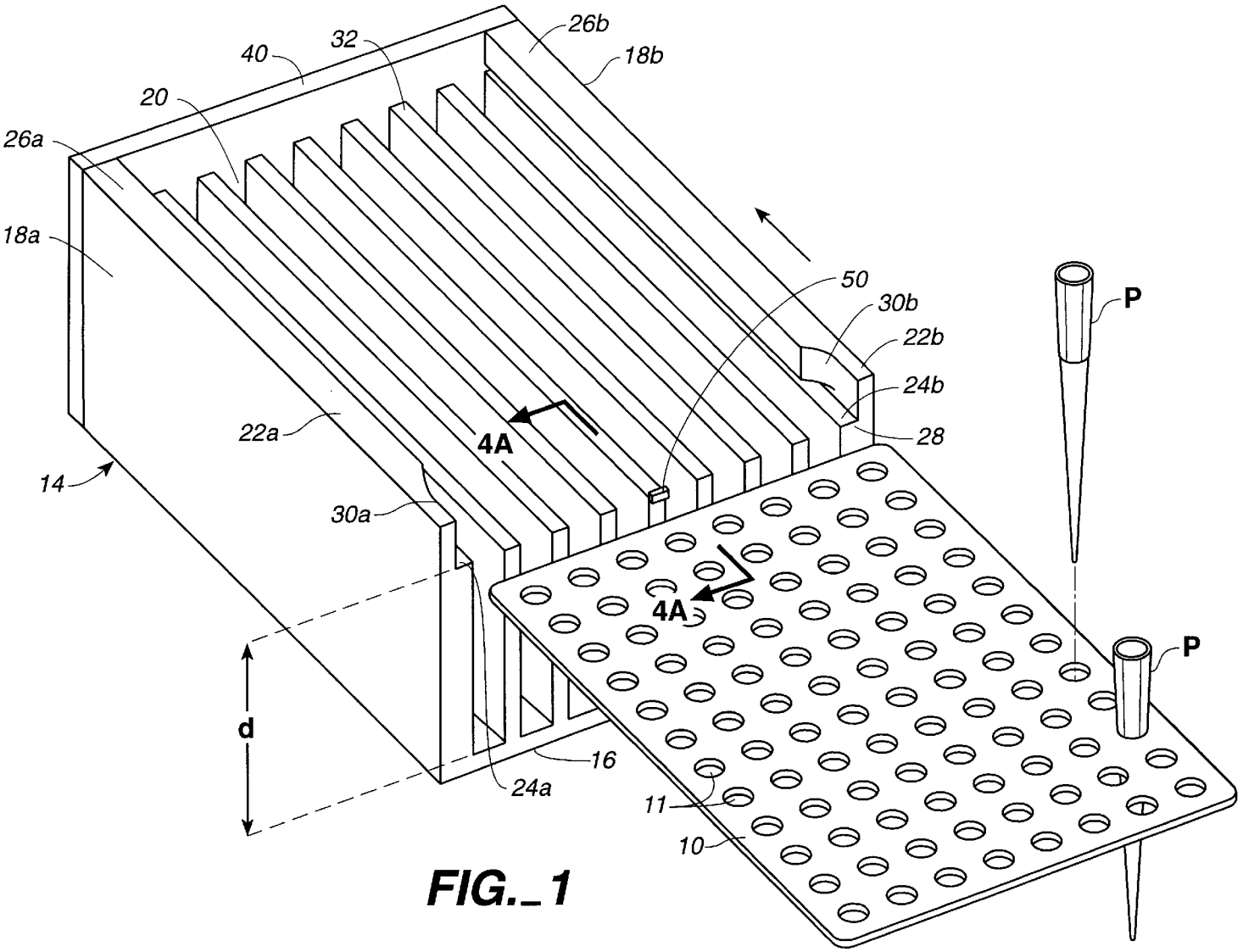
FIG. 1 is a top perspective view of an embodiment of the present invention, namely a support useful for a pipette tip holder with pipette tips therein.

An illustration of an embodiment of the present invention, which is a support for a pipette tip holder and pipette tips therein, is shown in FIG. 1. Thus, as is known, a tip holder 10 is adapted to receive pipette tips P. The inventive support 14 comprises a bottom member 16, and a pair of opposed side walls 18*a,* 18*b*. The side walls 18*a,* 18*b* are attached to the bottom member 16 and extend therefrom at least a distance (d). The bottom member 16 and side walls 18*a,* 18*b* form a cavity 20 therebetween.

Each side wall 18*a,* 18*b* defines a slot 22*a,* 22*b* therein. The slots are in a facing relationship and extend between first ends 24*a,* 24*b* and second ends 26*a,* 26*b* along a support plane 28. The support plane 28 is parallel to the bottom member 16 and spaced the distance (d) above it.

The distance (d) is such that when the tip holder 10 containing pipette tips P is inserted into the slots 22*a,* 22*b,* the tips P do not touch the bottom member 16 but continue to rest on the tip holder 10. The slots 22*a,* 22*b* are sized to match the thickness of the tip holder 10. The slots 22*a,* 22*b* are deep enough such that they provide sufficient resistance to keep a tip holder 10 from being unintentionally lifted upwards during use.

The side walls 18*a,* 18*b* may extend above the slots 22*a,* 22*b* to any preferred distance. Typically the walls 18*a,* 18*b* will not extend above the tops of the tips P when a tip holder 10 is inserted into the slots 22*a,* 22*b,* thus providing for easier access to the tips P for use.

In addition, the support 14 has at least one support member 32 disposed within the cavity 20. The upper surface of this support member 32 lies in the support plane 28, and is the same distance (d) above the bottom member 16 as the slots 22*a,* 22*b*. Thus an inserted tip holder 10 rests in the slots 22*a,* 22*b* and on the support member 32. The number, size and spacing of the support members 32 can vary to accommodate various tips P and tip holders 10. Preferably, though not required, for maximum support there is a support member 32 in between each row of tips P. Thus for a standard pipette tip holder 10 consisting of eight rows and twelve columns, there would preferably be seven support members 32, each evenly aligned and spaced parallel to and between the side walls 18*a,* 18*b*.

One function of the support members 32 is to provide support for the tip holder 10 when tips P are being removed for use. Typically, tips P are removed by an instrument that inserts itself into the top of the tip P and presses down so as to wedge the tip P onto the instrument. The support members 32 should have sufficient strength such that the tip holder 10 does not bow down, warp or otherwise move out of place when the tips P are removed in such a fashion.

Figure 2:
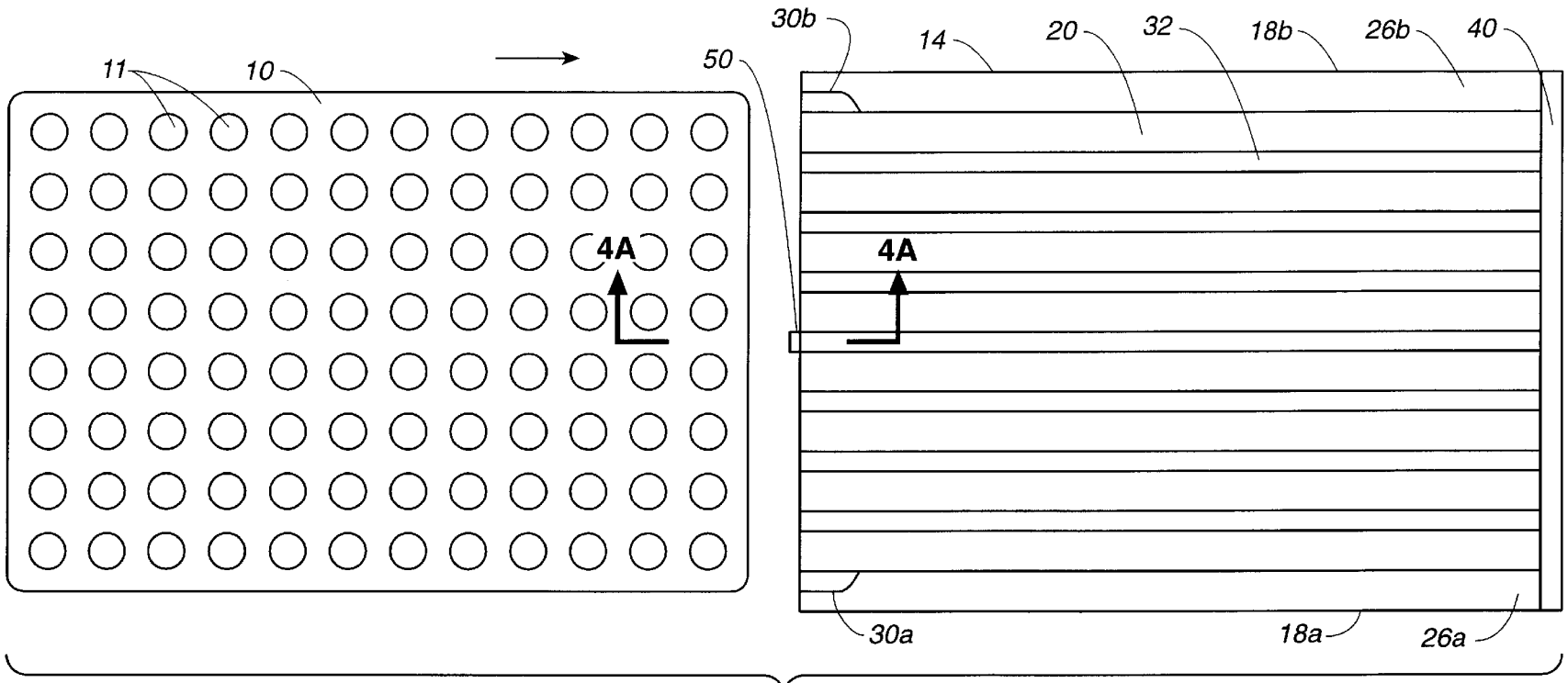
FIG. 2 illustrates a top view of the support of the present invention, showing a pipette tip holder in a position to be inserted into the support of FIG. 1.

As shown in FIG. 2, the side walls 18*a,* 18*b* include an aligning member 30*a,* 30*b* adjacent to the first slot ends 24*a,* 24*b*. The aligning member 30*a,* 30*b* is of sufficient construction to align the pipette tip holder 10 in both slots 22*a,* 22*b* when it is slid in. The aligning member 30*a,* 30*b* can take the form of recess portions as illustrated in FIG. 2.

Figure 3:
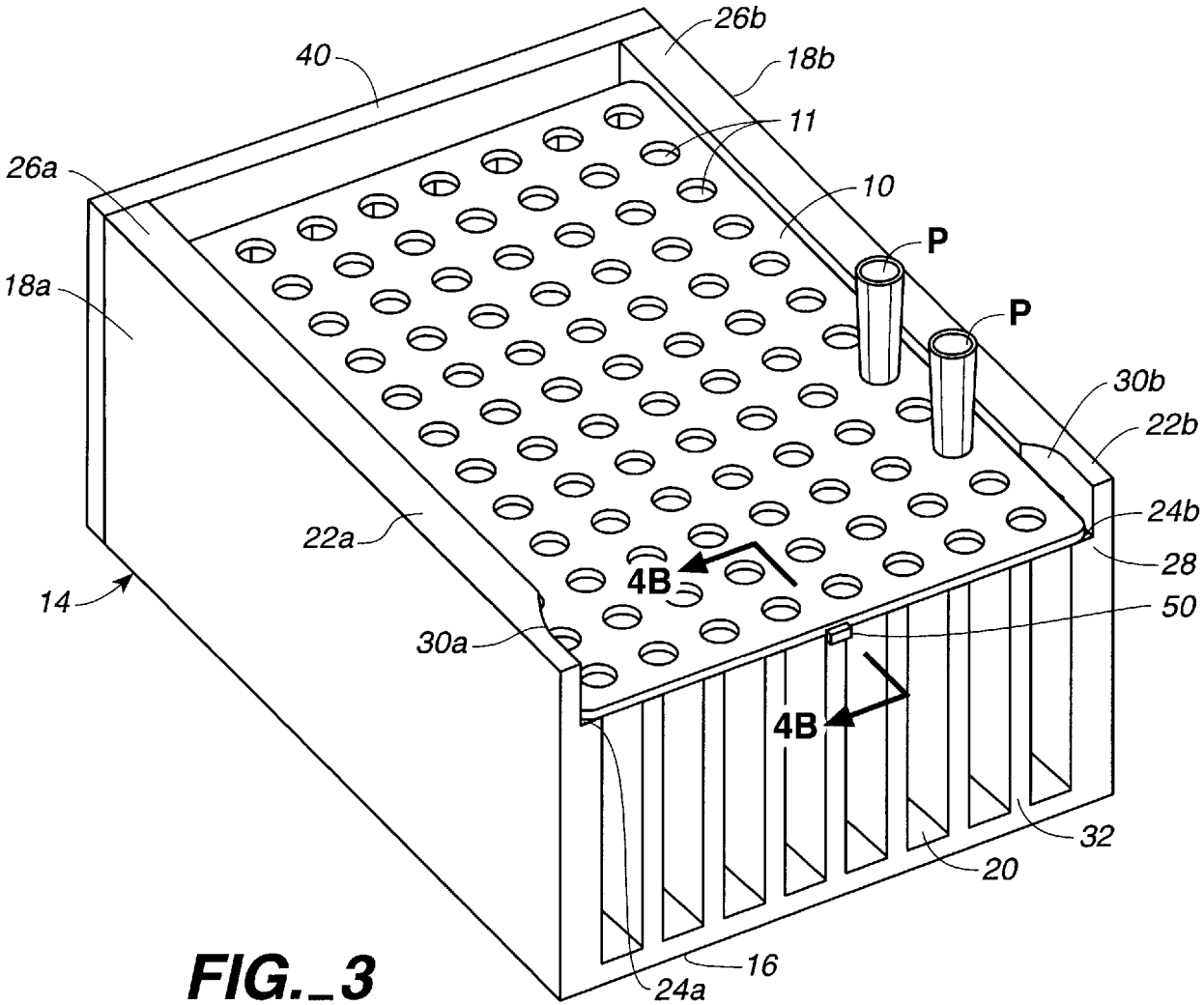
FIG. 3 is a perspective view of the pipette tip holder, with a plurality of pipette tips therein, fully inserted into the support of the present invention.

FIG. 3 illustrates a tip holder 10, with a plurality of tips P, fully inserted into the support 14, and ready for autoclaving or use.

Figure 4A:
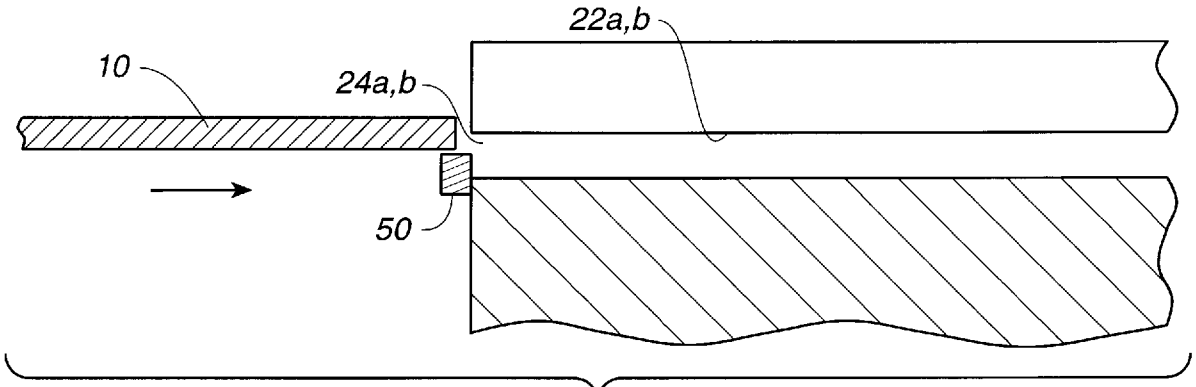
FIG. 4A is a cross-section of a pipette tip holder in preparation for sliding into the slots of the present invention.
Figure 4B:
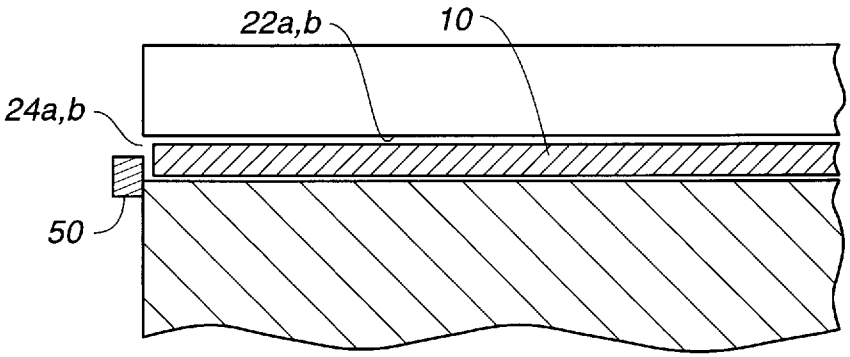
FIG. 4B is a cross-section of a pipette tip holder as in FIG. 4A, but where the holder is fully inserted.

As best illustrated in FIGS. 3, 4A and 4B, the first slot ends 24*a,* 24*b* are open to receive a pipette tip holder 10 when it is slid in. The second slot ends 26*a,* 26*b* are closed to stop further sliding of the pipette tip holder 10 after it has been fully inserted.

The second slot ends 26*a,* 26*b* are closed by a stopping means 40 placed at the back of the slots 22*a,* 22*b* such that the tip holder 10 is stopped in its slide once it is fully inserted into the support 14. The stopping means can take various forms, as are illustrated in FIGS. 5A, 5B, 5C and 5D.

Figure 5A:
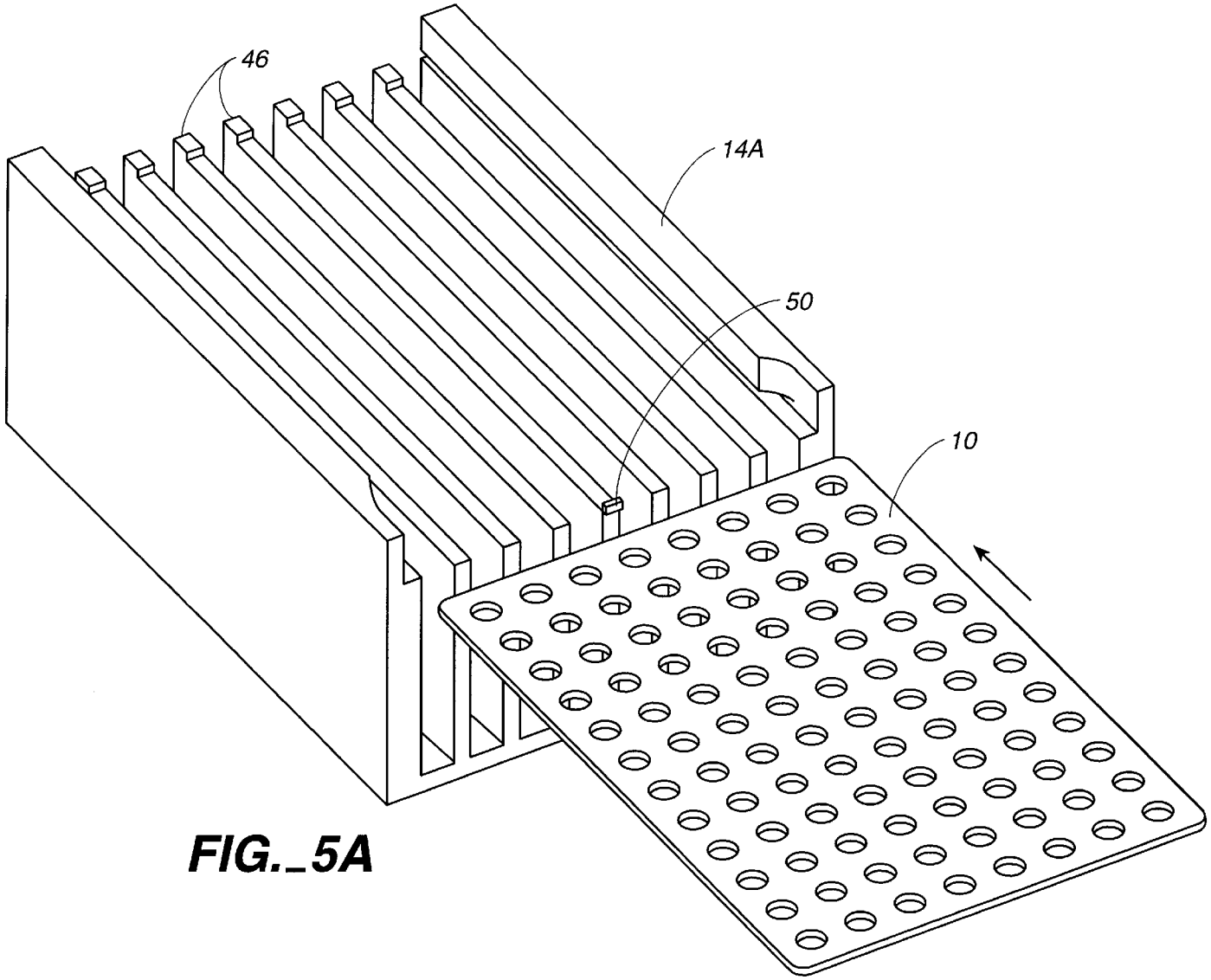
FIG. 5A illustrates one means for stopping the slide of a pipette tip holder in the slots of the present invention, where the stopping means is a plurality of raised stop ends.
Figure 5B:
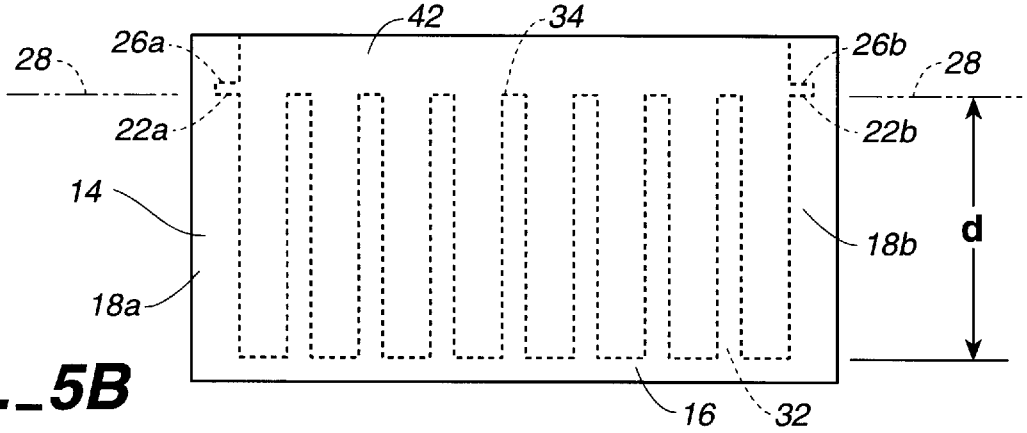
FIG. 5B illustrates another means for stopping the slide of a pipette tip holder in the slots of the present invention, where the stopping means is a solid member.
Figure 5C:
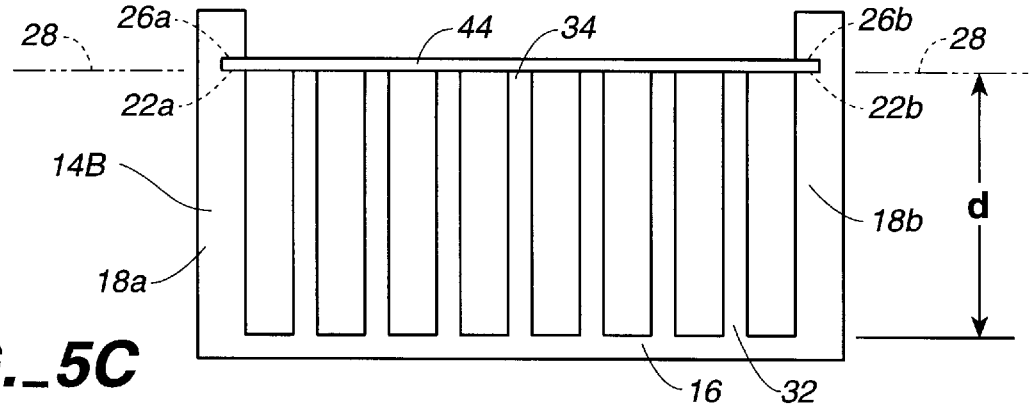
FIG. 5C illustrates yet another means for stopping the slide of a pipette tip holder in the slots of the present invention, where the stopping means is a bar; and, FIG. 5D illustrates still yet another means for stopping the slide of a pipette tip holder in the slots of the present invention, where the stopping means is a block.
Figure 5D:
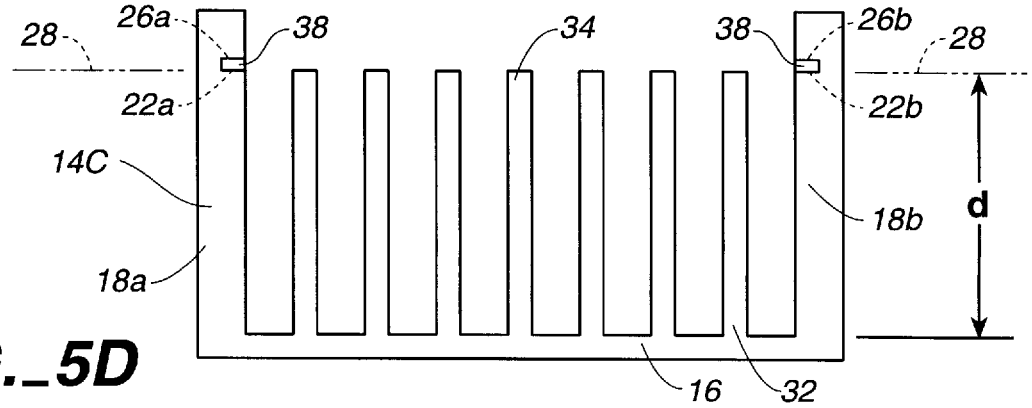

Turning to FIG. 5A, a preferred embodiment is illustrated with a plurality of raised stop ends 46. The raised stop ends 46 extend at least a distance (d+x) above the support members 32 to prevent further sliding of the pipette tip holder 10 once inserted into the support 14. An alternate embodiment is shown in FIG. 5B which is a solid member 42 adjacent to the second ends 26*a,* 26*b,* thus closing the end of the slots 22*a,* 22*b*. Another alternate embodiment is shown in FIG. 5C where there is a horizontal bar 44 crossing from the second end 26*a* of one slot 22*a,* across the support members 32 to the second end 26*b* of the other slot 22*b*. Yet another alternate embodiment is shown in FIG. 5D which contains a block 38 at the end of each slot 22*a,* 22*b*.

Various embodiments of the side walls are contemplated. The side walls 18*a,* 18*b* of the support 14 are preferably solid, but could be partially open if the material is of sufficient strength to otherwise give the support 14 the required rigidity. The support 14 must be rigid enough to hold the tip holder 10 firmly in place when the tips P are removed and not warp, lean, or otherwise become askew during use.

A wide variety of materials can be used for forming support 14. For example, suitable materials include various plastics, metals, ceramics, and combinations of such materials. The particular choice of materials may depend upon the application for which the pipette tips P with which the support rack will be utilized are to be put to use. Where elevated temperatures are contemplated, then the support 14 is preferably made of autoclavable materials. The support 14 can be placed in an autoclavable box for autoclaving purposes, if desired, whereupon the lid of the box will be closed and the entire box will be autoclaved. The entire system is easy to clean and durable, such that it can be used for a large number of cycles.

The support 14 is preferably used repeatedly in conjunction with disposable tip holders 10 and/or tips P. Thus the user can purchase loose tips P that are subsequently filled into associated tip holders 10, or buy tips P already inserted into the tip holders 10, either singly or in packs. A user then picks up the tip holder 10 full of tips P by the edges or other convenient means, uses the recessed portions of the aligning member 30*a,* 30*b* at the first slot end 24*a,* 24*b* of the slots 22*a,* 22*b* to align the tip holder 10 with the support 14, and slides the tip holder 10 into the slots 22*a,* 22*b*. The tip holder 10 will slide along the slots 22*a,* 22*b* until it is fully inserted. The support 14 can then be placed into an autoclavable box and autoclaved. When the autoclaving is finished, the box can be opened and the tips P used. The support 14 with inserted tip holder 10 and tips P can remain in the autoclave box or it can be removed for use.

When the tip holder 10 is empty or the user wishes to remove the tip holder 10, the tip holder 10 is simply grasped near the first ends 24*a,* 24*b* and slid out of the support 14. The user can then either discard the tip holder 10 or refill it with tips P. The support 14 can remain conveniently on the lab bench or other work surface until another tip holder 10 with tips P is inserted.

This method of positioning the tip holder 10 and tips P is a significant improvement over the complicated and unwieldy devices of previous systems. Particularly, the support 14 of the present invention allows the user to easily align the tips P and tip holder 10 with the support 14. The user need only purchase one tip support 14 and then refill it with tip holders 10 and tips P of different types and/or sizes, as often as needed.

It is claimed:

1. A support, useful with a pipette tip holder and pipette tips therein, comprising:

a bottom member; and a pair of opposed side walls attached to the bottom member and extending therefrom at least a distance (d), the bottom member and side walls forming a cavity therebetween, each side wall defining a slot therein, the slots being in a facing relationship and extending between a first end and a second end along a support plane, the support plane being parallel to and spaced from the bottom member the distance (d), the first slot ends being open to receive a pipette tip holder when slidingly inserted therein, the second slot ends being closed to stop further sliding of the pipette tip holder therein.

2. The support of claim 1 wherein the side walls include an aligning member adjacent to the first slot ends and being of a construction sufficient to align the pipette tip holder in both slots when slidingly inserted therein.

3. The support of claim 1 further comprising at least one support member disposed within the cavity and having an upper surface lying in the support plane.

4. The support of claim 2 where the aligning member is a recess portion.

5. The support of claim 1 where the side walls are solid.

6. The support of claim 1 where the side walls are partially open.

7. The support of claim 1 where the slots are sufficiently deep to prevent the pipette tip holder from being lifted up as tips are removed.

8. The support of claim 1 where the second slot ends are closed by a solid member adjacent to the second ends.

9. The support of claim 1 where the second slot ends are closed by a bar extending between the slots in the support plane.

10. The support of claim 1 where the second slot ends are closed by a block.

11. The support of claim 1 where distance (d) is such that when a pipette tip holder is inserted into the slots, tips in the pipette tip holder do not touch the bottom.

12. The support of claim 1 where the side walls do not extend above the tops of the tips when a pipette tip holder with at least one pipette tip is inserted in the slots.

13. The support of claim 3 where at least one support member has sufficient strength to prevent the pipette tip holder from being bent as tips are removed from the pipette tip holder.

14. The support of claim 13 including at least one support member in between each row of pipette tips in a pipette tip holder.

* * * * *